United States Patent [19]

Grehier et al.

[11] Patent Number: 4,762,172

[45] Date of Patent: Aug. 9, 1988

[54] HEAT EXCHANGE DEVICE OF THE PERFORATED PLATE EXCHANGER TYPE WITH IMPROVED SEALING

[75] Inventors: Alain Grehier, Paris; Alexandre Rojey, Garches, both of France

[73] Assignee: Institute Francais du Petrole, Rueil-Malmaison, France

[21] Appl. No.: 877,038

[22] Filed: Jun. 23, 1986

[30] Foreign Application Priority Data

Jun. 25, 1985 [FR] France ..... 85 09771

[51] Int. Cl.[4] ..... F28D 7/02

[52] U.S. Cl. ..... 165/165; 277/215; 277/235 R; 277/DIG. 6

[58] Field of Search ..... 165/164, 165, 166; 277/235 R, 235 B, DIG. 6

[56] References Cited

U.S. PATENT DOCUMENTS

| | | | |
|---|---|---|---|
| 1,863,586 | 6/1932 | Wilke | 165/166 |
| 2,834,440 | 5/1958 | Berg | 165/166 X |
| 2,893,702 | 7/1959 | Richardson | 165/165 X |
| 4,333,975 | 6/1982 | Booth | 277/235 B X |
| 4,368,779 | 1/1983 | Rojiy et al. | 165/165 |
| 4,435,235 | 3/1984 | Atkenson et al. | 277/235 R X |
| 4,436,145 | 3/1984 | Manfredo | 165/166 X |
| 4,477,094 | 10/1984 | Yamamoto et al. | 277/235 B |

FOREIGN PATENT DOCUMENTS

| | | | |
|---|---|---|---|
| 691967 | 5/1949 | United Kingdom | 165/166 |
| 2093582 | 9/1982 | United Kingdom | 165/166 |

*Primary Examiner*—Ira S. Lazarus
*Assistant Examiner*—Peggy Neils
*Attorney, Agent, or Firm*—Millen & White

[57] ABSTRACT

A heat exchange device is provided whose exchange zone is formed of a stack of perforated plates having perforations disposed so that superimposition of the perforations creates flow spaces for at least two fluids at different temperatures, said perforated plates being separated two by two by at least one seal disposed so that each perforation of the plates corresponding to a flow space through which fluid passes is separated from the perforations corresponding to the flow spaces through which a different fluid passes, said stack being kept at a clamping pressure of 2 to 50 bars by means of a plurality of tie-rods passing through it and said seal being formed by an expanded graphite manufactured under such conditions that it has a bulk density of about 200 to 500 $kg.m^{-3}$.

10 Claims, 3 Drawing Sheets

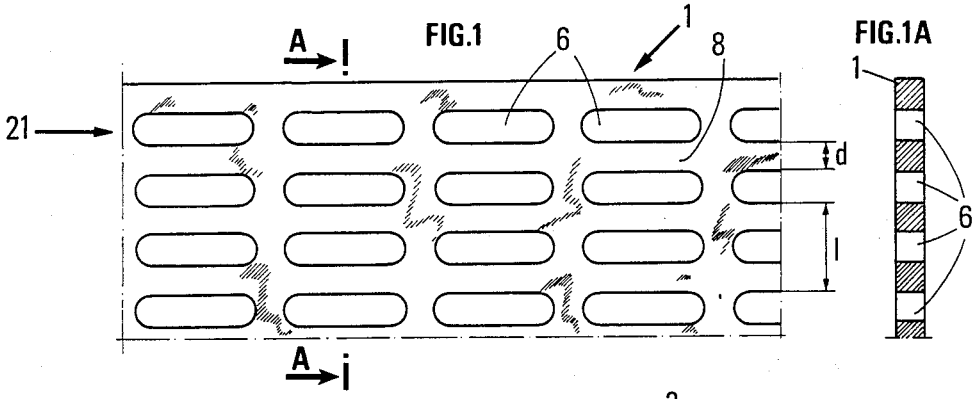
FIG.1
A
A
1
6
8
21
d
l
FIG.1A
1
6
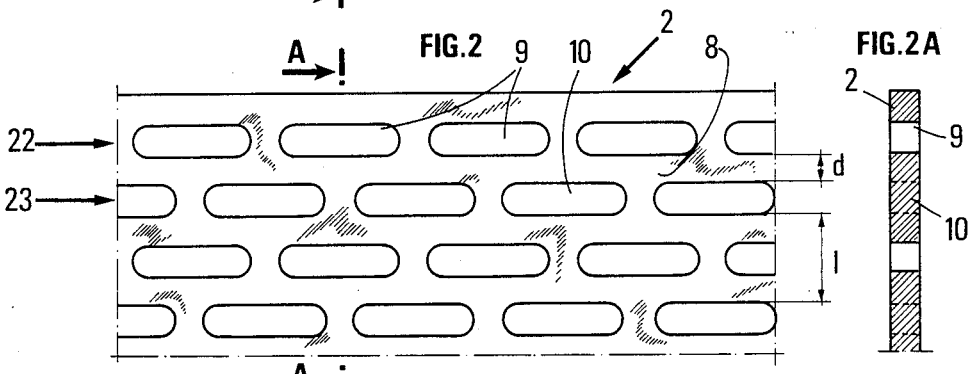
FIG.2
A
A
2
9
10
8
22
23
d
l
FIG.2A
2
9
10
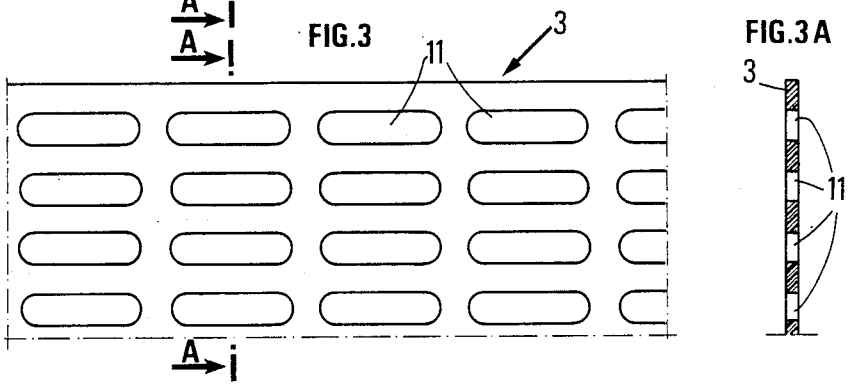
FIG.3
A
A
3
11
FIG.3A
3
11
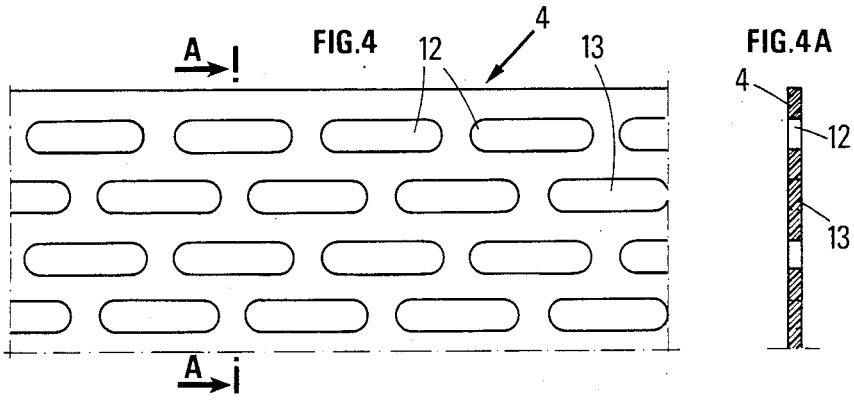
FIG.4
A
A
4
12
13
FIG.4A
4
12
13

HEAT EXCHANGE DEVICE OF THE PERFORATED PLATE EXCHANGER TYPE WITH IMPROVED SEALING

BACKGROUND OF THE INVENTION

1. Field of Invention

The present invention relates to a heat exchange device of a perforated plate exchanger type with improved sealing.

2. Description of the Prior Art

For some time, so-called "compact" exchangers have been proposed formed of stacks of perforated plates, in which the perforations are disposed so that stacking thereof creates separate spaces in which the fluids (liquids, gases or smoke) taking part in the heat exchange may flow.

The applicant has himself described devices of this type, in particular in the French Pat. No. 2455721 "Compact heat exchanger" and the French patent application No. 2500610 "Perforated plate heat exchanger".

Depending on the arrangement of the perforations on the plates and the arrangement of the plates in the stack forming the exchanger, the fluid flow spaces may consist of channels whose direction is perpendicular to the plane of the plates or "flow networks" created by interconnection of perforations between the adjacent plates of the stack.

In all cases, the flow spaces through which the fluids taking part in the heat exchange travel (assemblies of channels or networks of interconnected perforations) must be separated from the adjacent flow spaces through which flow another fluid so as to reduce as much as possible leaks between the different flow spaces through which different fluids pass. To obtain this result, it would be necessary to use perforated plates of very good inherent flatness having a good surface condition, very tightly clamped against each other.

Obtaining improved flatness and surface condition for the perforated plates forms a restriction which may lead to considerable increase of the complexity and of the cost of their fabrication. Since the desired sealing further requires considerable clamping of the stack, it would be necessary to use means such as flanges of sufficient thickness on each side of the stack (which would make the assembly considerably much heavier), as well as tie-rods in sufficient number and quality for reducing the internal leaks to a value compatible with the desired operation of the device. There would also follow an increase in the complexity and cost of mounting exchangers of this type.

Under these conditions, it was particularly important to efficiently overcome the problem raised and it has occured to turn to the use of joints, disposed alternately with all the plates of the stack. Now, the constructional characteristics of compact exchangers and particularly the pressure to be exerted for maintaining cohesion of the stack are such that it is particularly difficult to select a material adapted for the contemplated use.

Now, it has been discovered recently that, among the very large number of materials which could be contemplated for this use, certain expanded graphites such as defined further on offer an assembly of properties which make them particularly well adapted to this use.

The main object of this invention is to provide a plate heat exchanger which, in addition to the advantages of low cost, compactness, relative lightness and ease in distributing the fluids, does not have any leaks or has negligible leaks between the fluids between which the heat exchange is to take place.

SUMMARY OF THE INVENTION

The heat exchangers of the invention may be defined generally as comprising a stack of perforated plates with, between any two consecutive plates, at least one seal disposed so that each perforation of the plate corresponding to a flow space through which a fluid passes is separated from the perforations corresponding to the flow spaces through which a different fluid passes, cohesion of the plates stack being provided by a plurality of tie-rods passing through said stack perpendicularly to the planes of the plates distributed over the whole volume thereof and exerting a clamping pressure of about 2 to 50 bars, said seal being formed of an expanded graphite manufactured under conditions such that it has bulk density of about 200 to 500 $kg.m^{-3}$.

The expanded graphite used as the material forming the seals of the exchangers of the invention is advantageously in the form of flexible sheets of variable thickness obtained by compression moulding of expanded graphite particles, under temperature and pressure conditions such that they have the aboved-mentioned bulk density, as well as suitable compressibility characteristics so that crushing thereof, under the clamping pressures used, allows them to play their role, that is to say, to compensate for the flatness defects of the plates of the stack, these defects being generally of a few tenths of a millimeter, in particular when the plates are made from metal (for example sheets of steel or of different alloys).

Some other physical and mechanical characteristics of the expanded graphite considered are given hereafter:

Young's modulus: $0.7.10^6$ to $150.10^6 N.m^{-2}$

Heat conductivity:

in a direction parallel to the plane of the graphite sheet: 15 to 400 $W.m^{-1}.°C.^{-1}$ in the direction perpendicular to the plane of the graphite sheet: $<15$ $W.m^{-1}.°C.^{-1}$.

In the stacks forming the exchange zones of the devices of the invention, the thickness of the expanded graphite seals represents in general 2.5 to 10 times the mean amplitude of the flatness defects which said seals must compensate for. In particular when the plates are made from metal and have flatness defects of a few tenths of a millimeter, for example from about 0.05 to 0.5 mm, the thickness of the seals may be about 0.1 to 5 mm. It is very often between about 0.5 and 2.5 mm. The thickness of the plates is generally from 2 to 20 mm.

Considering the compressibility characteristics of the graphite used, the clamping pressure applied, which may be from about 2 to 50 bars, causes crushing of the expanded graphite seals by 10 to 90% with respect to their initial thickness. In some cases, a clamping pressure of about 2 to 25 bars may be sufficient. It is very often between about 10 and 25 bars. The crushing may then be from about 40 to 70% of the initial thickness.

BRIEF DESCRIPTION OF THE DRAWINGS

FIG. 1 is a top view of a plate having parallel rows of elongate perforations;

FIG. 1A is a cross-section taken along line A—A of FIG. 1;

FIG. 2 is a top view of a plate having parallel rows of staggered, elongate perforations;

FIG. 2A is a cross-section taken along line A—A of FIG. 2;

FIG. 3 is a top view of an expanded graphite seal with parallel rows of elongate perforations;

FIG. 3A is a cross-section taken along line A—A of FIG. 3;

FIG. 4 is a top view of an expanded graphite seal with parallel rows of staggered elongate perforations;

FIG. 4A is a cross-section taken along lines A—A of FIG. 4;

DESCRIPTION OF PREFERRED EMBODIMENTS

Figure 5:
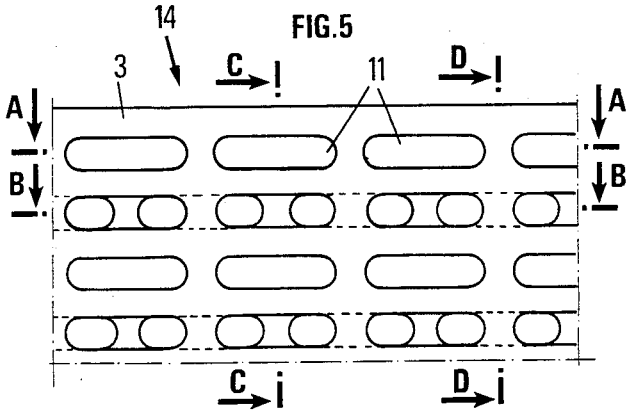
FIG. 5 is a top view of a stack formed of the plates and seals of FIGS. 1-4.

The construction of the perforated plate heat exchangers of the invention, having expanded graphite seals, will be better understood from the following description of different preferred embodiments, in which the overall structure of the exchangers responds to structures already described in the French patent application No. 2500610, the disclosure of which is included in the present description by reference.

In these particular embodiments, the stacked plates for forming the heat exchange zone comprise elongate perforations disposed in parallel rows. Other forms of perforations and other arrangements may be contemplated.

In the particular embodiments described hereafter, the sealant may consist of a suitably perforated expanded graphite sheet or an assembly of expanded graphite strips, themselves suitably perforated, or else and assembly of suitably disposed unperforated expanded graphite strips.

In a first particular embodiment, the exchange zone properly speaking is formed essentially of a stack forming a right prism, of polygonal plates having preferably at least a pair of sides parallel to each other (for example rectangular plates) and seals of the same shape but of a thickness not necessarily equal to the thickness of the plates, said plates and said seals being alternated in the stack so that, preferably, a single seal is inserted between successive perforated plates of the stack, said plates and said seals being provided with elongate perforations disposed in rows parallel with each other, said perforations being disposed and said plates and said seals being stacked so that the rows of perforations of one plate are superimposed on the rows of perforations of the seals which are adjacent thereto.

Furthermore, if we consider the whole of the plates of the stack, for at least a part of the rows of perforations of any intermediate plate, each perforation is in communication with two perforations of the corresponding row of the plate which precedes it and with two perforations of the corresponding row of the plate which follows it.

The intermediate seals may have, for the rows considered, perforations coinciding with those of the corresponding row of the plate which precedes each said seal. Or else the intermediate seals may have, for the rows considered, perforations coinciding with those of the corresponding row of the plate which follows each said seal. Or else again, the intermediate seals may have, for the rows considered, perforations coinciding alternately with those of the corresponding row of the preceding plate for one seal and with those of the corresponding row of the following plate for the following seal, this alternation of arrangement of the perforations being repeated over the whole stack.

In practice, the alternated stack of plates and seals may be formed by alternately superimposing perforated plates and unperforated expanded graphite sheets, by cutting out the perforations of each expanded graphite sheet through the perforations of the plate which follows said expanded graphite sheet to be perforated, during stacking.

In some cases, for a part of the rows of perforations, each perforation of any intermediate plate may be in communication with a single perforation of the corresponding row of the preceding plate and with a single perforation of the corresponding row of the following plate. In this case, each intermediate seal has perforations which, for the rows considered, coincide substantially with the perforations of the corresponding rows of the plates, this arrangement of the perforations of the plates and the seals being kept over the whole stack.

One embodiment of this type is illustrated in FIGS. 1, 1A, 2, 2A, 3 and 3A.

FIG. 1 is an elevational view of a plate 1 with parallel rows 21 of elongate perforations 6, said perforations being of the same dimension, evenly spaced apart along said rows, the spacing between the closest ends of two adjacent perforations 6 in the same row is less than the length of the perforation 6, the ends of the perforations being in addition aligned with each other from one row to another, in a direction perpendicular to the direction of said rows.

FIG. 1A shows a cross-sectional view of a plate 1 through the plane A.A of FIG. 1.

FIG. 2 is an elevational view of a plate 2 with parallel rows 22 and 23 of perforations 9 and 10 respectively, these rows being at the same distance from each other as the rows 21 on the plates 1; the perforations 9 and 10 having the same dimensions as perforations 6 on plates 1 and being, in the same row 22 or 23, evenly spaced apart in the same arrangement as the perforations 6 in the same row 21 of a plate 1 but, from a row 22 to a row 23, the perforations 9 and 10 are offset in a staggered arrangement.

FIG. 2A shows a cross-sectional view of a plate 2 through the plane A.A of FIG. 2.

FIG. 3 is an elevational view of an expanded graphite seal 3 having the same shape as a plate 1 (it has perforations 11).

FIG. 3A shows a cross-sectional view of the seal 3 through the plane A.A of FIG. 3. It shows, for the seal 3, a thickness different from the thickness of plates 1 and 2.

FIG. 4 is an elevational view of an expanded graphite seal 4 having the same shape as a plate 2 (it has perforations 12 and 13). FIG. 4A shows a cross-sectional view of seal 4 through the plane A.A of FIG. 4. It shows, for seal 4, a thickness different from the thickness of plates 1 and 2.

In a first variant of this embodiment the exchange zone is formed by the successive stacking of a plate 1, a seal 3, a plate 2, a seal 3 and so on. In a second variant, the exchange zone is formed by the successive stacking of a plate 1, a seal 4, a plate 2, a seal 4 and so on. Finally, in a third variant, the exchange zone is formed by the successive stacking of a plate 1, a seal 4, a plate 2, a seal 3 and so on.

FIG. 5 is an elevational view of a stack 14, formed in accordance with the first above described variant. FIGS. 5A and 5B show respectively cross-sectional views of the stack 14 through the planes A.A and B.B of FIG. 5.

Figure 5C:
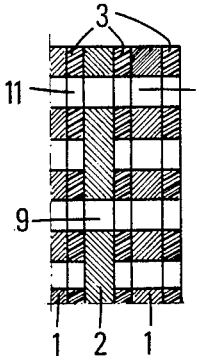
FIG. 5C is a cross-section taken along line C—C of FIG. 5.
Figure 5D:
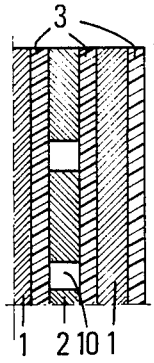
FIG. 5D is a cross-section taken along line D—D of FIG. 5.
Figure 5A:
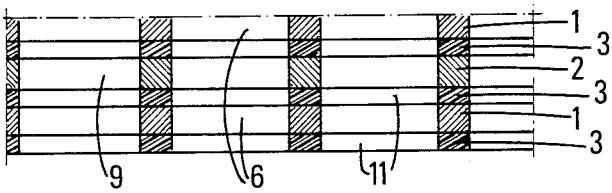
FIG. 5A is a cross-section taken along lines A—A of FIG. 5.
Figure 5B:
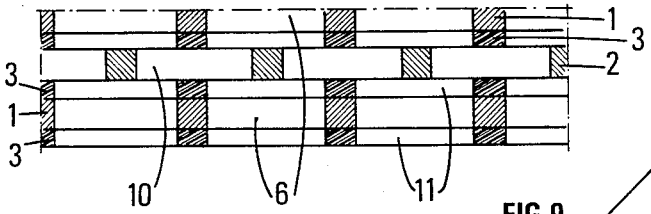
FIG. 5B is a cross-section taken along lines B—B of FIG. 5.

FIGS. 5C and 5D are respectively cross-sectional views of the stack 14 through the planes C.C and D.D of FIG. 5.

The stacks corresponding to the second and third above-described variants have not been shown in the Figures.

In a second particular embodiment, the construction of the stack of plates forming the exchange zone is similar to that described in the first embodiment above, but the seals inserted between the perforated plates are in the form of perforated strips whose thickness is the thickness of the seal, a perforated strip corresponding to one row of perforations out of two.

This embodiment is illustrated by the FIGS. 1, 1A, 2, 2A, 6, 6A and 7 to 7C. The plates are similar to plates 1 and 2 of FIGS. 1 and 1A, 2 and 2A respectively.

Figure 6:
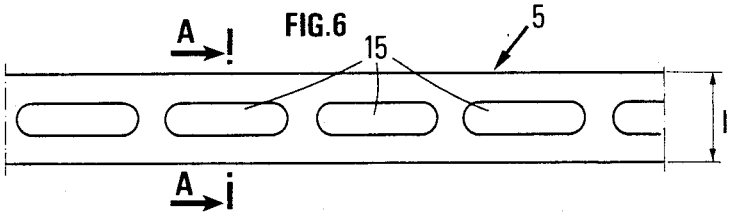
FIG. 6 is a top view of a perforated graphite seal in the form of a strip.
Figure 6A:
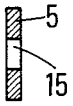
FIG. 6A is a cross-section taken along line A—A of FIG. 6.

FIG. 6 is an elevational view of a seal 5 in the form of a strip with perforations 15 corresponding to the perforations 6 of plates 1 or to the perforations 9 of plates 2. FIG. 6A shows a section of a seal 5 through the plane A.A of FIG. 6. The width 1 of strips 5 is for example from $b+a/2$ to $b+2a$, if we designate by a the distance, measured on the plates, between the nearest edges of the perforations of two adjacent rows and by b the width of the perforations. This width of strips 1 is advantageously from $b+a$ to $b+2a$. It is preferably $b+2a$. It is this preferred width which has been designated by 1 in FIGS. 1 and 2.

In the particular embodiment described, the exchange zone is formed by the successive stacking of a plate 1 of a suitable number of strips 5, a plate 2, again strips 5 and so on.

Figure 7:
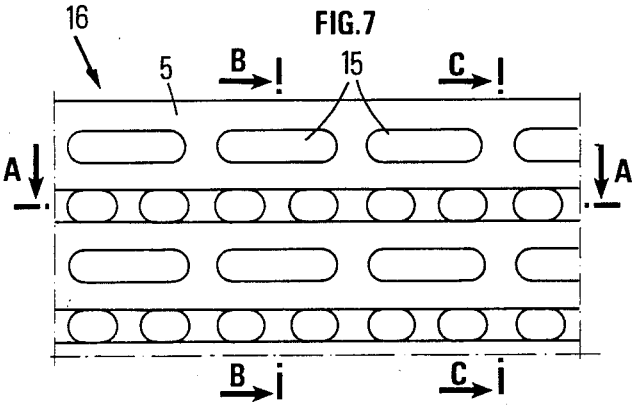
FIG. 7 is a top view of a stack utilizing the strip seals of FIG. 6.

FIG. 7 is an elevational view of such a stack 16.

Figure 7B:
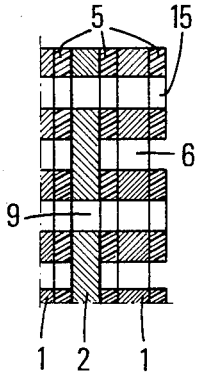
FIG. 7B is a cross-section taken along lines B—B of FIG. 7.
Figure 7C:
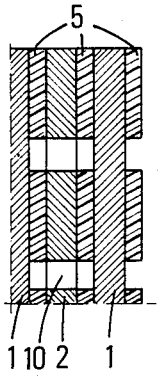
FIG. 7C is a cross-section taken along line C—C of FIG. 7.
Figure 7A:
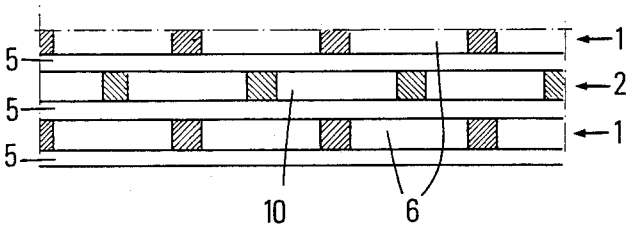
FIG. 7A is a cross-section taken along lines A—A of FIG. 7.

FIG. 7A shows a cross-sectional view of stack 16 through the plane A.A of FIG. 7. FIGS. 7B and 7C are respectively cross-sectional views of the stack 16 through the planes B.B and C.C of FIG. 7.

In a third embodiment, the construction of the stack of plates forming the exchange zone is similar to that described in the above embodiment, but the seals inserted between the perforated plates are in the form of strips whose thickness is that of the seal, a strip corresponding to the separation gap disposed between two adjacent rows of perforations.

This embodiment is illustrated in FIGS. 1, 1A, 2, 2A, 8, 8A and 9. The plates are similar to plates 1 and 2 of FIGS. 1 and 1A, 2 and 2A.

Figure 8:
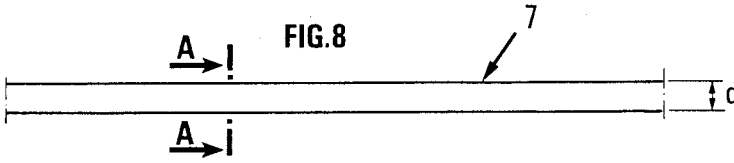
FIG. 8 is a top view of an unperforated graphite seal.
Figure 8A:
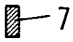
FIG. 8A is a cross-section taken along lines A—A of FIG. 8.

FIG. 8 is an elevational view of a seal 7 in the form of an unperforated strip. The width d of a strip 7 is preferably equal to the distance, measured on the plates, between the closest edges of the perforations of two adjacent rows, that is to say to the width of the separation gaps 8. The preferred width d has been shown in FIGS. 1 and 2. However, the width d may be less than the above indicated value so that, if a is the distance between the closest edges of the perforations of two adjacent rows, d may be generally between $a/10$ and a, and advantageously between $a/2$ and a.

In the particular embodiment described, the exchange zone is formed by the successive stack of a plate 1, a suitable number of strips 7, a plate 2, again a set of strips 7 and so on.

Figure 9:
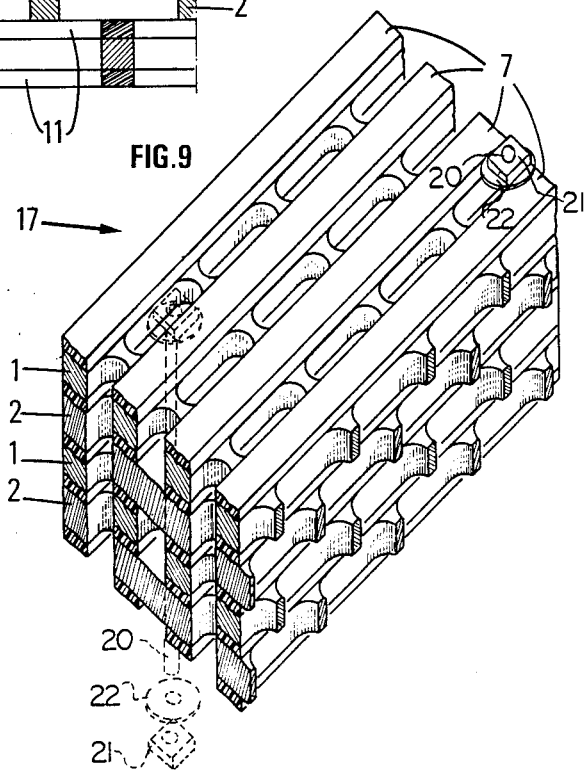
FIG. 9 is a perspective view of a heat exchanger assembled from the elements of FIGS. 1 and 2 in accordance with the teachings of the instant invention.

FIG. 9 is a perspective view of such a stack 17.

In the heat exchangers of the invention, clamping of the stack formed of perforated plates and seals is provided by means of metal tie-rods 2 which pass through said stack perpendicularly to the planes of the plates, said tie-rods being advantageously introduced into a part of the ducts 11 formed by superimposition of a part of the perforations 1 of said plates and said seals. The clamping properly speaking, the detail of which is not supplied in the present description, may be provided by conventional means, such as threaded rods terminating the tie-rods 20 and nuts 21 bearing during tightening thereof on the endmost plates of the stack or on flanges disposed on each side of the stack so as to transmit the clamping force while distributing it over the whole surface of the plates. Clamping may also be applied to the stack by inserting between the nuts or other clamping means and the endplates 22 or endflanges of the stack spring-washers or another resilient device so as to allow the variations of height of the stack related to the variations of the temperature thereof, while maintaining sufficient and not excessive clamping on the stack so as to ensure the internal sealing of the exchanger during its operation. The fraction of the so-called "straight" ducts, formed by the superimposition of a part of the perforations of the plates and the seals, occupied by the tie-rods is limited so as to leave free passage for the fluid in a sufficient number of said straight ducts, but this fraction of straight ducts occupied by the tie-rods must also be sufficient for the clamping force made possible by the number and tensile strength of the tie-rods in extreme operating conditions to reach the clamping pressure required for the internal sealing of the exchanger. The seals considered in the invention, made from expanded graphite, allow such internal sealing to be obtained under as low a pressure as possible compatible with a sufficient mechanical maintenance of the stack. A complementary advantage is obtained by the fact that the seal used is a good heat conductor so that it participates in the transfer of heat from the relatively hot fluid towards the relatively cold fluid.

In the heat exchangers of the invention, the perforated plates may be made from metal. They may be also formed of other materials, such for example as synthetic thermoplastic or heat hardenable materials, ceramic material or else high density graphite.

These heat exchangers are more particularly used for exchanges between two fluids, particularly for recovering heat from furnace or boiler smoke (first fluid), the recovered heat serving for heating for example, air (second fluid).

What is claimed is:

1. A heat exchange device including an exchange zone formed of a stack of perforated plates with perforations disposed so that, in the stack of said plates, superimposition and alignment of the perforations creates flow spaces for at least two fluids, in which, between consecutive plates of said stack seals are inserted to compensate for flatness defects in said plates; the seals being disposed so that aligned perforations of the plates through which one of said fluids flows, is separated from aligned perforations through which another fluid flows, wherein the cohesion of said stack is maintained by a clamping pressure of about 2 to 50 bars exerted by a plurality of tie-rods passing through some of the aligned perforations of said stack, oriented perpendicular to the planes of the plates and distributed over the whole volume thereof; the seals being formed of expanded graphite manufactured under conditions such that the expanded graphite has a bulk density of about 200 to 500 $kg.m^{-3}$.

2. The device as claimed in claim 1, wherein the flatness defects of the plates have a mean amplitude and the seals have a thickness which represents a dimension from 2.5 to 10 times the mean amplitude off the flatness defects of the plates.

3. The device as claimed in claim 2, wherein the thickness of the seals is in the range from about 0.1 to about 5 mm.

4. The device as claimed in claim 2, wherein the plates have a thickness in the range of from about 2 to about 20 mm.

5. The device as claimed in claim 1, wherein the pressure for clamping the stack is in a range from 10 to 25 bars.

6. The device as claimed in claim 1, wherein, on said plates, the perforations are elongate and are disposed in parallel rows, the rows of perforations of an intermediate plate being superimposed on the rows of perforations of the plates which precedes the intermediate plate an on the rows of perforations of the plate which follows the intermediate plate, and, for at least a part of the rows of perforations of an intermediate plate, each perforation is in communication with two perforations of the corresponding row of the plate which precedes the intermediate plate and with two perforations of the corresponding row of the plate which follows the intermediate plate and, for the complementary part of the rows of perforations of an intermediate plate, each perforation is in communication with a single perforation of the corresponding row of the plate which precedes the intermediate plate and with a single perforation of the corresponding row of the plate which follows the intermediate plate.

7. The device as claimed in claim 6, wherein each seal inserted between any two consecutive plates is formed of a sheet having parallel rows of elongate perforations, said perforations coinciding substantially with the perforations of the corresponding rows of the preceding plate of the following plate, or said perforations of said seal coinciding alternately with those of the corresponding row of the plate which precedes the plate and with those of the corresponding row of the plate which follows the plate.

8. The device as claimed in claim 1, wherein said exchange zone is formed by alternate stacking of plates (1) comprising parallel rows (21) of elongated perforation (6), said perforations (6) being of the same size and evenly spaced along said rows (21), the space in between the closest ends of two adjacent perforations (6) in the same rows (21) being less than the length of said perforations (6), the ends of said perforations (6) being further, from one row to another, aligned with each other in the direction perpendicular to the direction of said rows and plates (2) comprising parallel rows (22) and (23) of elongate perforations (9) and (10) respectively, said rows being at the same distance from each other as the rows (21) on the plates (1), said perforations (9) and (10) being of the same size as the perforations (6) of the plates (1) and evenly spaced along said rows (22) and (23) respectively, the space between the closest ends of two adjacent perforations (9) or two adjacent perforations (10) in the same row (22) or (23) being less than the length of said perforations (9) and (10), the ends of said perforations (9) and (10) being further staggered from one row (22) to a row (23), the seats inserted between any two consecutive plates (1) and (2) being formed of perforated expanded graphite sheets (3) whose perforations (11) have substantially the same shape and the same arrangement as the perforations (6) and the plate (1), or said seals being formed of expanded graphite sheets (4) whose perforations (12) and (13) have substantially the same form and the same arrangement as the perforations (9) and (10) of the plates (2).

9. The device claimed in claim 1 wherein said exchange zone is formed by alternate stacking of plates (1) comprising parallel rows of elongate perforations (6), said perforations (6) being of the same size and evenly spaced along said rows, the spacing between the closest ends of two adjacent perforations (6) in the same row (21) being less than the length of said perforations (6), the ends of said perforations (6) being further, from one row to another, aligned with each other in a direction perpendicular to the direction perpendicular to the direction of said rows and plates (2) comprising parallel rows (22) and (23) of elongate perforations (9) and (10) respectively, said rows being spaced from each other at the same distance as the rows (21) on the plates (1), said perforations (9) and (10) being of the same size as the perforations (6) of the plates (1) and evenly spaced apart along said rows of types (22) and (23) respectively, the spacing between the closest ends of two adjacent perforations (9), or two adjacent perforations (10), and the same row (22) or (23) being less than the length of said perforations (9) and (10), the ends of said perforations (9) and (10) being further staggered from one row (22) to a row (23), the seals inserted between any two consecutive plates (1) and (2) being formed of perforated expanded graphite strips (5) whose perforations (15) correspond to perforations (6) of the plates (1) or to the perforations (9) of the plates (2) and whose width is at most equal to the distance between the closest edges of the perforations situated on each side of the perforations (15) and at least equal to the width of the perforations (15) increased by half the distance separating the two closest edges of two adjacent rows.

10. The device as claimed in claim 1, where in said exchanged zone is formed by alternate stacking of plates (1) comprising parallel rows of elongate perforations (6), said perforations (6) being of the same size and evenly spaced along said rows, the spacing between the closest ends of two adjacent perforations (6) in the same row (21) being less than the length of said perforations (6), the ends of said perforations (6) being further, from one row to another, aligned with each other in a direction perpendicular to the direction of said rows, and plates (2) comprising parallel rows (22) and (23) on elongate perforations (9) and (10) respectively, said rows being spaced apart from each other by the same distance as the rows (21) on plates (1), said perforations (9) and (10) being of the same size as the perforations (6) of plates (1) and evenly spaced apart along said rows (22) and (23) respectively, the spacing between the closest ends of two adjacent perforations (9) or two adjacent perforations (10) in the same row (22) or (23) being less than the length of said perforations (9) and (10), the ends of said perforations (9) and (10), the ends of said perforations (9) and (10) being further staggered from one row (22) to a row (23), the seals inserted between any two consecutive plates (1) and (2) being each formed of an assembly of expanded graphite strips (7), said strips (7) corresponding to gaps (8) between the adjacent rows (21) or plates (1) and between the adjacent rows (22) and (23) of plates (2) and whose width is at most equal to the distance separating the closest edges of perforations of two adjacent rows and at least equal to a tenth thereof.

* * * * *